US006322326B1

(12) United States Patent
Davis et al.

(10) Patent No.: US 6,322,326 B1
(45) Date of Patent: Nov. 27, 2001

(54) MODULAR CONDENSATE PUMP ASSEMBLY

(76) Inventors: Lee W. Davis, 10901 Rowlett Ave., Oklahoma City, OK (US) 73150; D. W. Hearn, Jr., 900 NW. 39th, Oklahoma City, OK (US) 73118; David Thomas Springer, 17013 Rose Hollow, Edmond, OK (US) 73003; James J. Coffey, 1409 Cherry La., Oklahoma City, OK (US) 73127; Jon David Currier, 3721 NW. 57th St., Oklahoma City, OK (US) 73112

( * ) Notice: Subject to any disclaimer, the term of this patent is extended or adjusted under 35 U.S.C. 154(b) by 0 days.

(21) Appl. No.: 09/489,574

(22) Filed: Jan. 21, 2000

Related U.S. Application Data

(60) Provisional application No. 60/117,775, filed on Jan. 29, 1999.

(51) Int. Cl.[7] ..... F04B 49/04; F04B 49/00; F04B 17/00

(52) U.S. Cl. ..... 417/40; 417/279; 417/360; 417/410.1; 417/423.1; 417/423.3

(58) Field of Search ..... 417/40, 279, 410.1, 417/423.1, 423.3, 360; 239/699

(56) References Cited

U.S. PATENT DOCUMENTS 3,758,236 * 9/1973 Zimmerman ..... 417/360
5,188,710 * 2/1993 Weber et al. ..... 202/185.3
5,562,003 * 10/1996 Lefebvre ..... 73/308
5,651,259 * 7/1997 Twyman ..... 62/93

* cited by examiner

*Primary Examiner*—Charles G. Freay
*Assistant Examiner*—Michael K. Gray
(74) *Attorney, Agent, or Firm*—Crowe & Dunlevy

(57) ABSTRACT

The present invention provides an improved, modular condensate pump assembly that has a collection tank which can be disposed at any convenient location to collect liquid condensate. A removable support plate is supported on the collection tank, and a pump extending into the collection tank is supported by the support plate. A liquid volume control float, also supported by the support plate, communicates with the pump to activate the pump to remove liquid condensate from the collection tank when the condensate liquid reaches a predetermined volume.

20 Claims, 5 Drawing Sheets

MODULAR CONDENSATE PUMP ASSEMBLY

RELATED APPLICATIONS

This application claims priority to U.S. Provisional Application No. 60/117,775 filed Jan. 29, 1999.

BACKGROUND OF INVENTION

1. Field of Invention

The present invention relates to the field of liquid pumping, and more particularly but not by way of limitation, to an improved modular condensate pump assembly.

2. Discussion

Especially in the field of heating and air conditioning, as well as in many other installations, liquid condensate is generated such as when moisture or humidity is present in the ambient atmosphere. Condensate runoff from cooled surfaces, such as from coils in air conditioning units, must be collected and appropriately discarded. Failure to do so can cause unwanted condensate collection resulting in environmental damage. For example, environmental damage can occur when condensate off flow spills onto a floor surface or onto anything disposed below the point of condensate drainage.

For many years sump pump assemblies have been available for the collection and disposal of condensation water. Such devices usually have a collection receptacle to receive the condensate, a centrifugal pump and a motor responsive to a liquid level float assembly that intermittently drives the pump to discharge the condensate from the collection receptacle to an available waste outlet or drain. One such prior art device is taught by U.S. Pat. No. 3,758,236 issued to Zimmerman. Numerous other such devices have been available commercially for quite some time.

Condensate pump assemblies, sometimes called sump assemblies, must often operate in adverse environmental conditions. Largely unattended, such devices often must provide reliable service over a span of many years. Cost considerations have demanded economy of manufacture, and many if not most commercially available sump assemblies are serviceable largely by replacement. That is, such devices are not economically repaired at field sites.

There is a need for a modular condensate pump assembly that offers economy of manufacture while affording maximum serviceability at the site of installation.

SUMMARY OF INVENTION

The present invention provides an improved, modular condensate pump assembly having a collection tank which is disposable at a convenient collection point for liquid condensate collection. A support plate is supported on the collection tank, and the support plate in turn supports a removable pump assembly which extends into the collection tank. A liquid volume control float, supported by the support plate to determine the level of condensate liquid in the collection tank, communicates with the pump to activate the pump to pump liquid from the collection tank when the condensate liquid reaches a predetermined volume.

An object of the present invention is to provide an improved condensate pump assembly that is of modular design and which offers installation flexibility, field serviceability and economy of manufacture.

Other objects, advantages and features of the present invention will become clear from the following detailed description and drawings when read in conjunction with the appended claims.

DESCRIPTION

Figure 1:
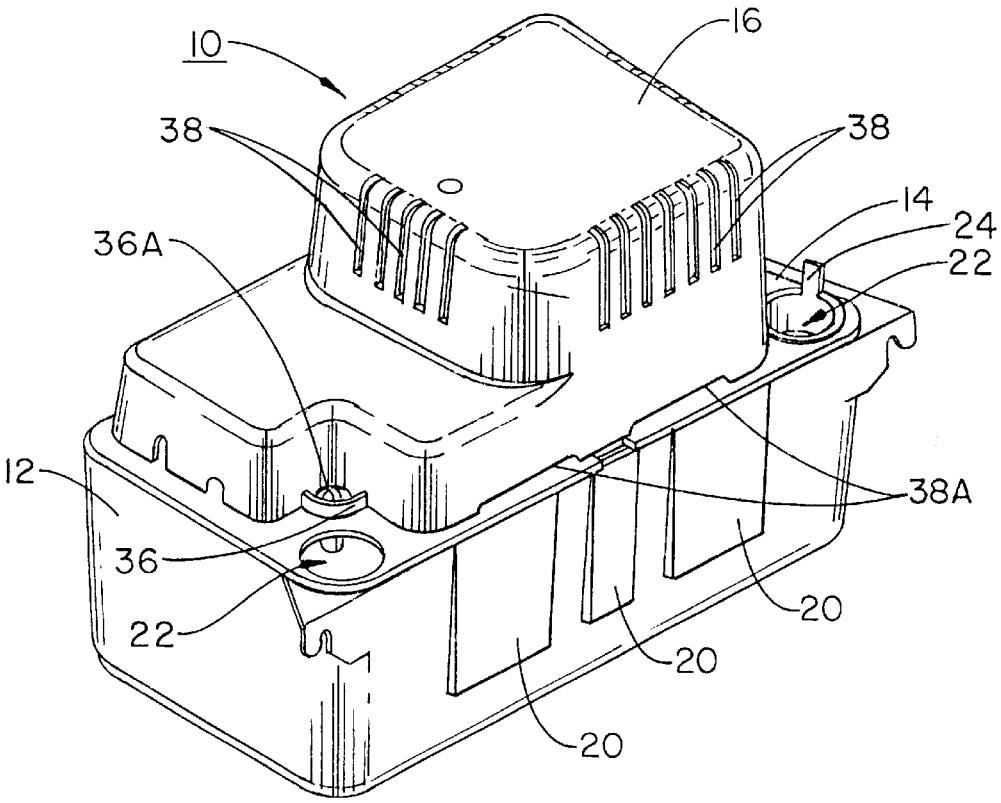
FIG. 1 a perspective view of a modular condensate pump assembly constructed in accordance with the present invention.
Figure 2:
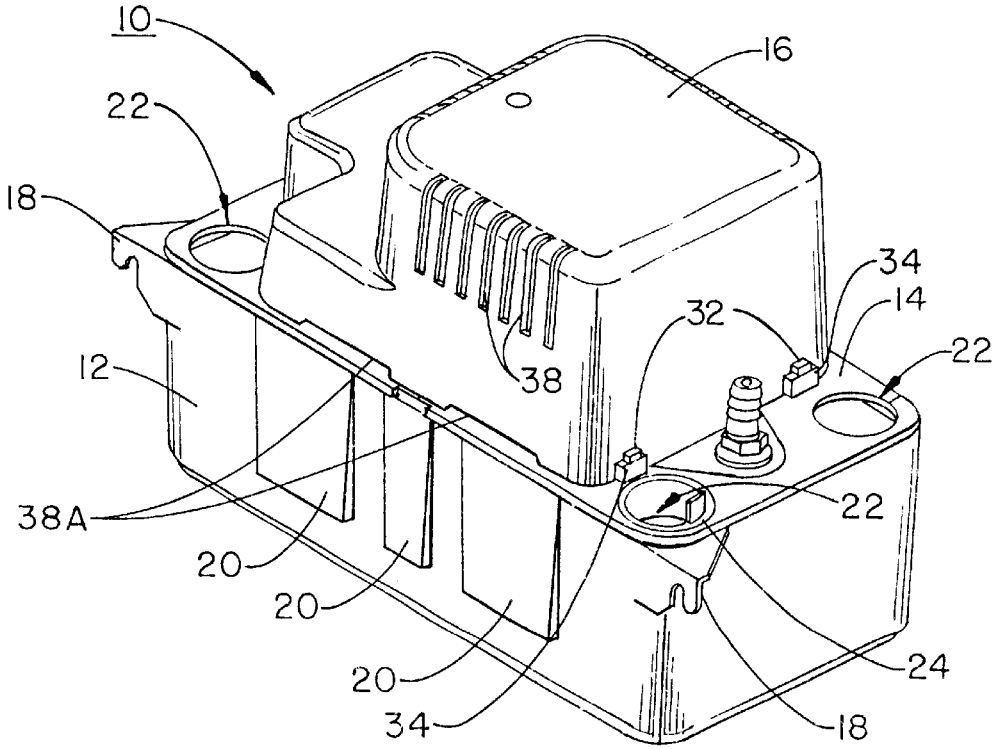
FIG. 2 is another perspective view of the condensate pump assembly of FIG. 1 from the opposing end thereof.

Referring to the drawings in general and in particular to FIGS. 1 and 2, shown therein is a modular condensate pump assembly 10 constructed in accordance with the present invention. The condensate pump assembly 10 has a collection tank 12, a support plate 14 which serves as a cover to the collection tank 12, and a cover 16 which is attached to the support plate 14. The collection tank 12 has a pair of mounting flanges 18 at two of its corners which provide a means to mount the collection tank 12 to a vertical wall surface or the like on fasteners (not shown).

Provided along a back side of the collection tank 12 are tapered wedge shaped portions 20 which serve to level the collection tank 12 when mounted to a vertical surface. The support plate 14 has three inlet apertures 22 disposed at corners thereof and which communicate with the interior of the collection tank 12. Typically, only one of the inlet apertures 22 remains open for condensate collection, and each of the unused inlet apertures 22 is sealed with a plastic plug 24 or the like. (one shown).

Figure 3A:
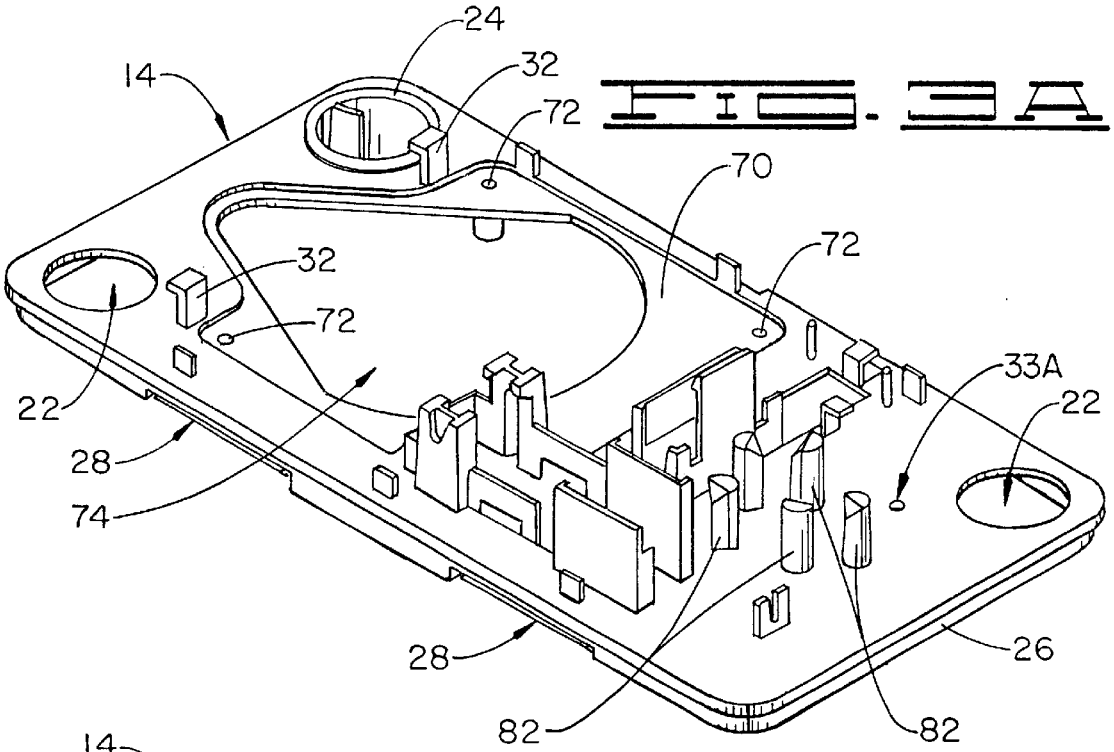
FIG. 3A is a perspective view of the support plate of the condensate pump assembly of FIG. 1.
Figure 4:
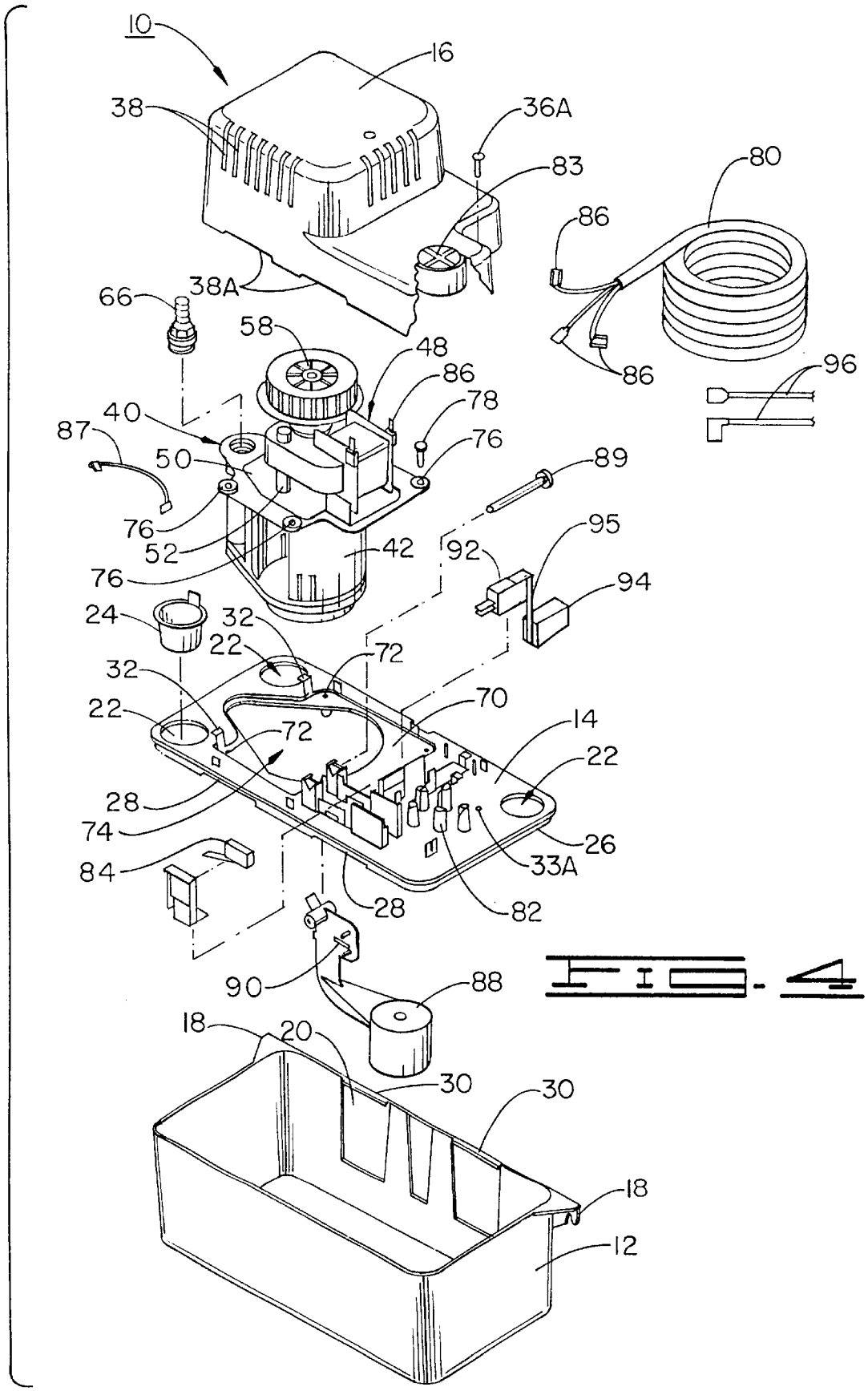
FIG. 4 is a perspective, exploded, partial cutaway view of the condensate pump assembly of FIG. 1.

Turning to FIGS. 3A and 4, the support plate 14 has a ridge 26 along its edge which is dimensioned to fit the dimensions and contour of an upper edge of the collection tank 12. Lower retention tabs 28 (FIG. 4) are provided for interlocking with corresponding upper retention tabs 30 on the condensate tank 12 to retain the support plate 14 in its assembled mode attached to the collection tank 12.

Figure 3B:
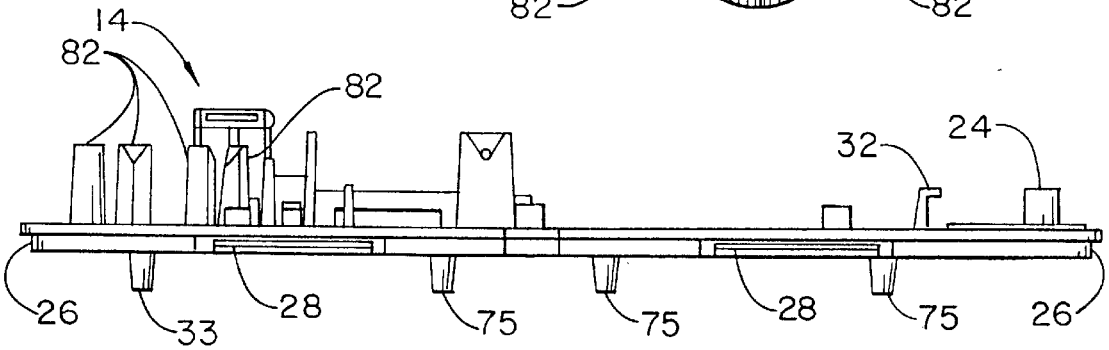
FIG. 3B is a side view of the support plate.
Figure 3C:
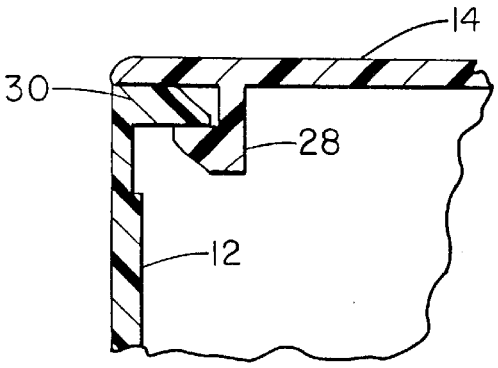
FIG. 3C is a partial cutaway end view of the support plate and collection tank of the condensate pump assembly of FIG. 1.

Turning to FIG. 3C, the support plate 14 and the collection tank 12 snap together upon alignment of the support plate 14 with the collection tank 12 and application of a compressive force to the top surface of the support plate 14. When applying the compressive force, the upper retention tabs 30 slide past the lower retention tabs 28 and interlock. Preferably, the collection tank 12 is made of a semi-rigid plastic such as acetyl butadiene styrene so that the walls can be partially deformed for the release and removal of the support plate 14.

Returning to FIG. 4, the construction of the support plate 14 provides for installation of the pump assembly 10 on a vertical surface in two positions so that the support plate 14 can be rotated 180 degrees on the collection tank 12 to provide increased adaptability for condensate collection at any of the four corners of the collection tank 12.

Turning to FIGS. 3A and 3B, shown therein are a pair of hook shaped retention tabs 32 that extend upward from the support plate 14 for attaching the cover 16 to the support plate 14. A boss 33 extends beneath the support plate 14 and a bore 33A for securing the cover 16 to the support plate 14 via a screw fastener 36A.

Returning to FIGS. 1 and 2, the cover 16 has a pair of loop connectors 34 that fit over and connect to the retention tabs 32. Additionally, the cover 16 has an apertured tab 36 which is disposed so that a screw fastener 36A extending therethrough threadingly engages the bore 33A. The shape and dimensions of the cover 16 are determined to provide cover to the components described below and is easily removable from the support plate 14 by removing the screw 36A, to provide access to the enclosed components. A plurality of air outlet ventilation slots 38 and air inlet ventilation slots 38A are provided in the cover 16 for the purpose discussed below.

Figure 5:
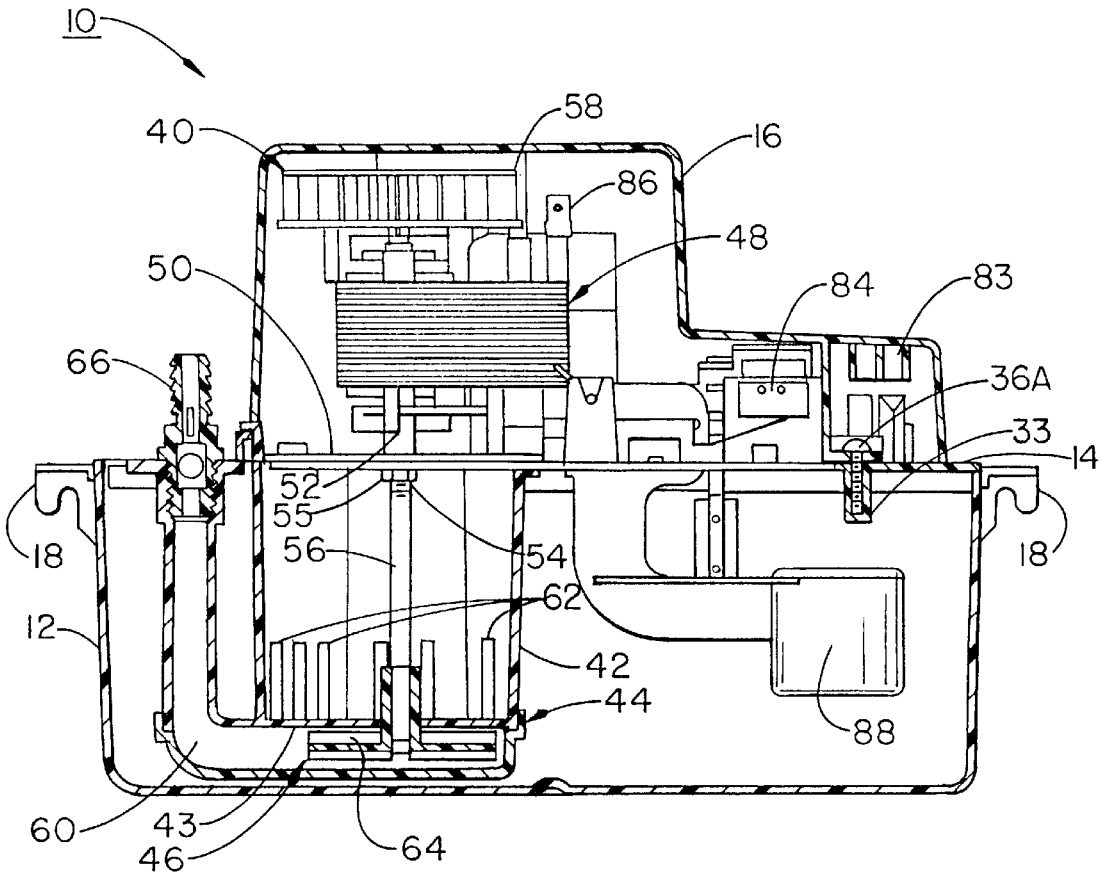
FIG. 5 is an elevational view, in cross section, of the condensate pump assembly of FIG. 1.
Figure 6:
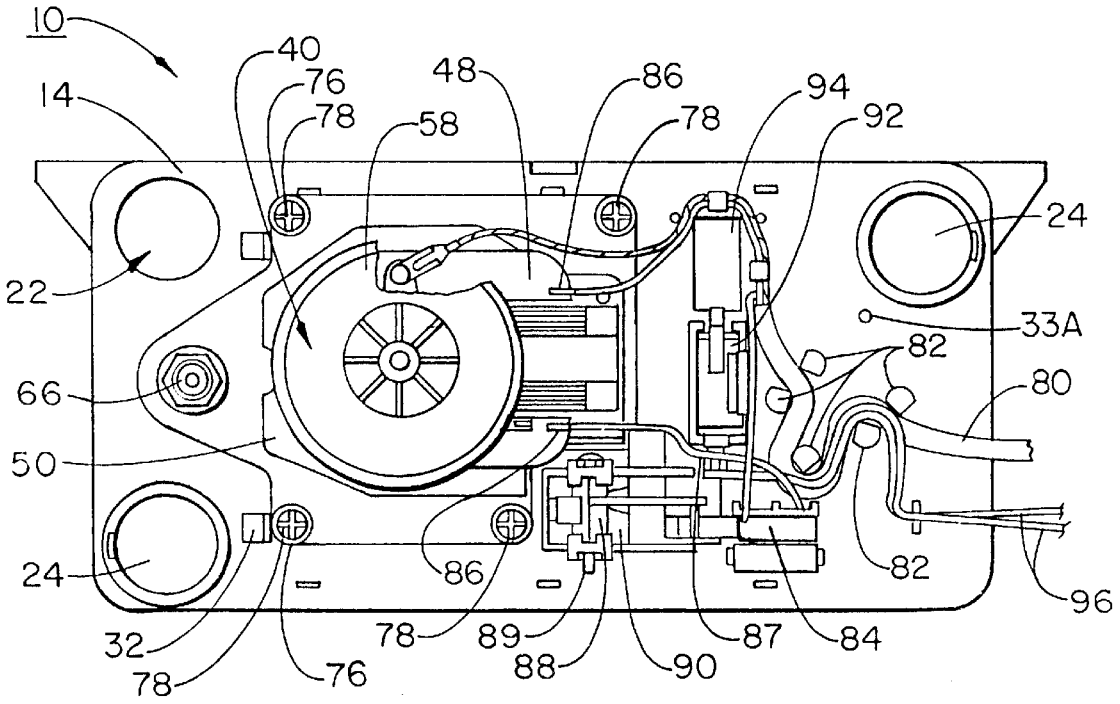
FIG. 6 is a top, partial cutaway view of the condensate pump assembly of FIG. 1.
Figure 7:
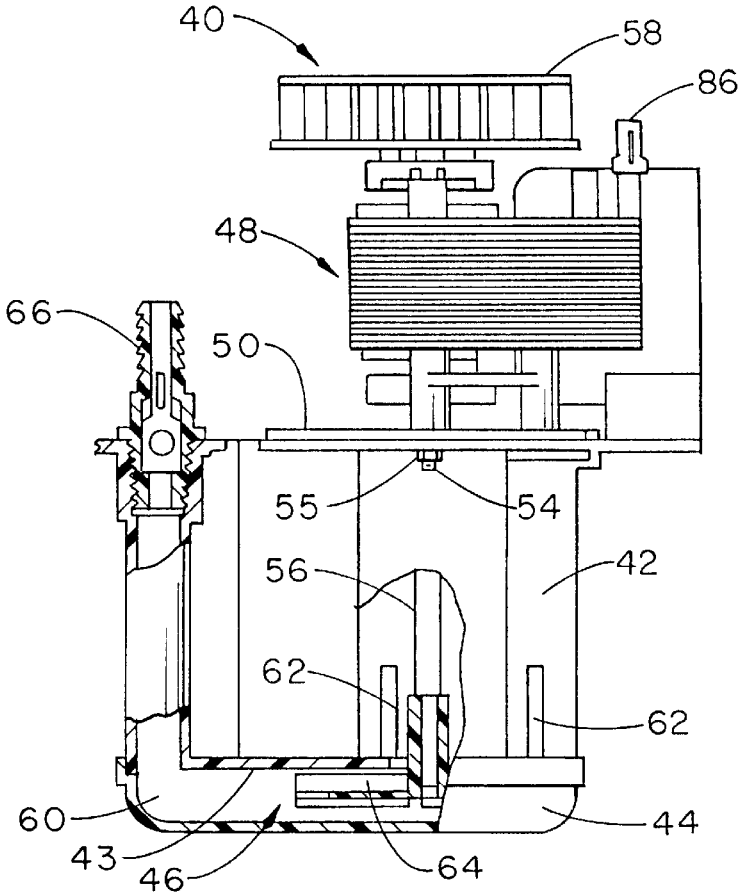
FIG. 7 is an elevational, partial cutaway view of the pump assembly of the condensate pump assembly of FIG. 1.

With reference to FIGS. 5 through 7, a removable pump assembly 40 is supported by the support plate 14 to extend into and communicate with the interior of the collection tank 12. The pump assembly 40 has a housing 42 of substantially open cylindrical construction with a seal plate 43 disposed at one end and to which a volute housing 44 is affixed to form a volute chamber 46. An electric motor 48 is attached to the housing 42 opposite the volute housing 44. A motor mount plate 50 is provided between the electric motor 48 and the housing 42 to provide a rigid mounting member. The electric motor 48 is attached to the motor mount plate 50 and both are supported at the upper end of the housing 42 on support posts 52 via bolts 54 and nuts 55. The motor mount plate 50 acts to protect the housing 42 from heat emitted from the electric motor 48.

The electric motor 48 has a drive shaft 56 which extends downwardly through an aperture in the motor mount plate 50. A turbine air fan 58, supported on the upper end of the drive shaft 56, is shaped to effect an air current directioned to cool the electric motor 48 when operated, the inlet ventilation slots 38A and the outlet ventilation slots 38 disposed about the cover 16 to facilitate such air ventilation.

The housing 42 forms an outlet conduit 60 that is in fluid attached to the volute chamber 46. A plurality of slots 62 in the housing 42 serve as fluid inlet ports in communication with the volute chamber 46. An impeller 64 is attached to the lower end of the drive shaft 56 and is disposed in the volute chamber 46 so that rotation of the impeller 64 by the electric motor 48 pumps condensate liquid through the outlet conduit 60. Disposed at the output end of the outlet conduit 60 is a removable hose connector and check valve 66 which threadingly attaches to the outlet conduit 60. The pump assembly 40, shown isolated in FIG. 7, is a completely operable, stand alone unit when removed from the support plate 14.

Returning to FIGS. 3A and 3B, the support plate 14 has a pump support plate 70 which has a plurality of attachment bores 72 and an access opening 74 configured to receive the extension of the housing 42 of the pump assembly 40 therethrough. The support plate 14 also has plurality of bosses 75 disposed to extend from the under surface of the support plate 14 opposite the attachment bores 72. The bosses 75 provide the mechanical structure to support the attachment bores 72.

As shown in FIG. 4, the housing 42 has a plurality of reinforced apertured attachment tabs 76 equal in number to the attachment bores 72 through which screw fasteners 78 (also shown in FIG. 6) extend to attach the pump assembly 40 to the support plate 14.

As shown in FIG. 6, an insulated power harness 80 with flag terminals winds between support tabs 82 extending upwardly from the support plate 14 and connects to the motor 48. The support tabs 82 act in conjunction with a power harness hold-down flange 83 (FIGS. 4 and 5) that extends downwardly inside the cover 16 to be positioned over the support tabs 82 to capture the insulated power harness 80 and prevent its accidental disengagement. The support tabs 82 prevent the insulated power harness 80 from lateral movement while the hold-down flange 83 prevents vertical displacement of the insulated power harness 80 upward and out of its path about the support tabs 82.

Figure 8A:
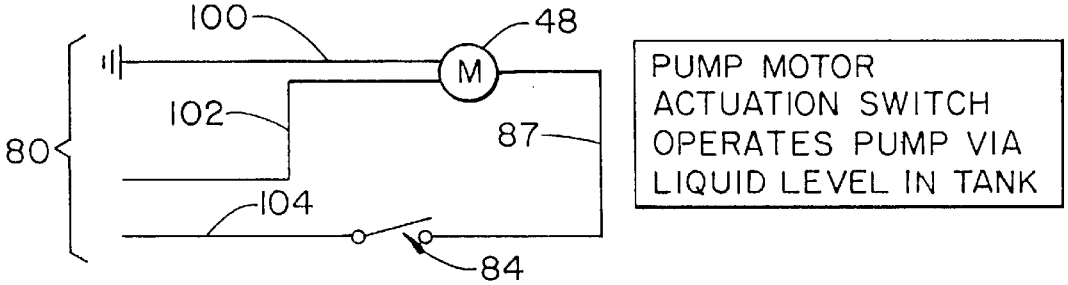
FIG. 8A is a schematic diagram of the electrical motor circuit of the condensate pump assembly of FIG. 1

As depicted in FIG. 8A, the insulated power harness 80 is connected to a power switch 84 and to the motor 48 via quick disconnect terminals 86 (shown in FIGS. 4–7).

The micro-switch 84 is supported by the support plate 14 and is engaged by a float 88 to create a condensate volume control for the collection tank 12. The micro-switch 84 is connected to the electric motor 48 via an insulated conductor 87 with a flag terminal. The quick disconnect terminals 86 of the power harness 80 permit easy removal of the pump assembly 40 from the condensate pump assembly 10 and thereby to be operationally tested prior to assembly into the condensate pump assembly 10. The float 88 is pivotally supported by a float pivot pin 89 on the support plate 14 so that the float 88 is disposed within the collection tank 12 to provide a two position mechanical liquid level control. When the condensate reaches a first predetermined level in the collection tank 12, the float 88 rises to a first start position to engage the micro-switch 84, which activates the electric motor 48 to discharge the condensate from the collection tank 12. When the level of condensate in the collection tank 12 drops below the first predetermined level, the float 88 falls to a second stop position, thereby switching the micro-switch 84 to deactivate the electric motor 48. The float 88 has a slot 90 for insertion of a locking tab (not shown) to lock the float 88 during shipment.

An additional safety switch 92 having a float 94 pivotally attached by a switch paddle 95 is supported by the support plate 14 to provide for independent detection of the level of condensate in the collection tank 12. The float 94, preferably made from a foamed thermoplastic, acts in a manner similar to the float 88 so that when the level of condensate reaches a second predetermined level (above the first predetermined level) in the collection tank 12, the float 94 rises to activate the safety switch 92. The safety switch 92 can be operably connected to a low voltage HVAC control system such as a thermostat (not shown) or a low voltage alarm system (not shown) by insulated conductors 96 so that the safety switch 92 controls the thermostat or alarm to indicate any failure of the pump assembly 40 to discharge condensate liquid from the collection tank 12 at a rate equal to or greater than that generated by the HVAC system. Both the switch 84 and the safety switch 92 are readily removable from the support plate 14 for ease of assembly and replacement.

Figure 8B:
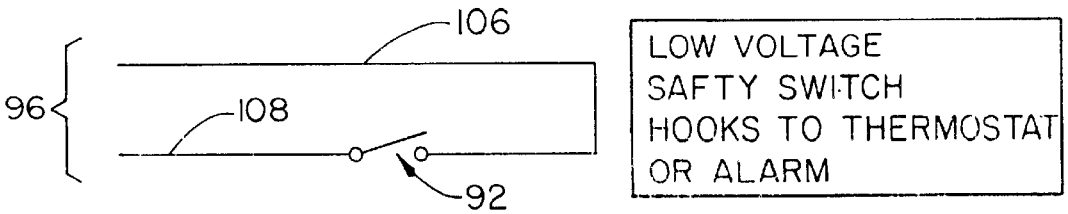
FIG. 8B is a schematic diagram of the safety switch thereof.

Since the safety switch 92 and the safety float 94 control and report condensate level independent of the switch 84 and the float 88, the pump assembly 10 has greater reliability. In particular, if a failure occurs in attempting to remove condensate due to a defect in either switch, the remaining functional switch, due to its independent connections, will continue to perform its function to control the condensate level or halt condensate generation in the event of a system malfunction. A diagram of the general electrical circuitry of both the power switch 84 and the safety switch 92 is shown in FIGS. 8A and 8B. FIG. 8A schematically depicts that the insulated power harness 80 comprises a ground line 100, a common line 102, and a power line 104. The power line 104 is connected to the switch 84; the common line 102 and the ground line 100 are connected to the motor 48; and the switch 84 is connected to the electric motor 48 via the insulated conductor 87.

FIG. 8B depicts the electrical connection for the safety switch 92. The safety switch 92 is connected to the HVAC low-voltage control system (not shown) via the insulated conductors 106 and 108.

It will be clear that the present invention is well adapted to attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A condensate pump assembly for pumping a condensate liquid, comprising:

a collection tank;

a support plate removably supported by the collection tank;

a pump assembly removably supported by the support plate and extending into the collection tank; and liquid volume control float supported by the support plate for determining a volume of condensate liquid in the collection tank and for communicating with the pump to pump liquid out of the collection tank when the volume of condensate liquid reaches a predetermined level within the collection tank.

2. A condensate pump assembly for pumping a condensate liquid, comprising:

a collection tank;

a support plate removably supported by the collection tank;

a pump assembly removably supported by the support plate and extending into the collection tank, wherein the pump assembly comprises:

a housing forming a drive shaft bore and having an outlet conduit, the housing extending into the collection tank, and having a fluid inlet port, seal plate forming a volute chamber in fluid communication with the fluid inlet port and having an outlet port;

a motor comprising:

a drive shaft extending through the drive shaft bore;

a fan connected to one end of the drive shaft, to effect an air flow directioned to cool the electric motor; and an impeller attached to the other end of the drive shaft and disposed in the volute chamber; and a hose connection communicating with the outlet conduit; and liquid volume control float supported by the support plate for determining a volume of condensate liquid in the collection tank and for communicating with the pump to pump liquid out of the collection tank when the volume of condensate liquid reaches a predetermined level within the collection tank.

3. The condensate pump assembly of claim 2, comprising a cover attachable to the support plate and enclosing the pump and the volume level control float.

4. The condensate pump assembly of claim 3, wherein the cover has inlet and outlet ventilation slots to facilitate air ventilation.

5. The condensate pump assembly of claim 4, wherein the cover has a loop connector and the support plate has a retention tab so that the loop connector fits over and connects to the retention tab to attach the cover to the support plate.

6. The condensate pump assembly of claim 5, wherein the support plate has a receiving attachment bore and the cover has an apertured tab, and a screw fastener disposable through the tab to engage the attachment bore to secure the cover to the support plate.

7. The condensate pump assembly of claim 6, wherein the collection tank and the support plate are made of acetyl butadiene styrene or other semi-rigid plastic.

8. The condensate pump assembly of claim 7, wherein the collection tank has a co-planer mounting flange for mounting the condensate pump assembly to a vertical wall surface, the collection tank having a wedge shaped portion adjacent to flange to level the collection tank when the collection tank is affixed to a vertical wall.

9. The condensate pump assembly of claim 8, wherein the collection tank has a plurality of retention lips disposed at its opening and the support plate has corresponding retention lips that removably interlock with the retention lips of the collection tank so that the support plate and the collection tank snap together thereby securing the support plate to the collection tank.

10. The condensate pump assembly of claim 9, wherein the liquid volume control float comprises:

a power micro-switch to activate the motor, and removably supported by the support plate;

a primary float removably pivotally supported by the support plate, and extending into the collection tank, the primary float engaging, the power micro-switch when the volume of condensate within the collection tank rises to a predetermined level, to activate the motor, the primary float falling to a bottom pivot position when the volume of condensate within the collection tank drops below the predetermined level, and disengaging the power micro-switch to deactivate the motor; and a power harness detachably connected to the power micro-switch and the electric motor.

11. The condensate pump assembly of claim 10, wherein the liquid volume control float further comprises:

a safety micro-switch removably supported by the support plate, to activate a low voltage control system; and a safety float extending into the collection tank, to detect when the volume of condensate reaches a second predetermined level above the first predetermined level, and operating independent of the primary float.

12. The condensate pump assembly of claim 11, wherein the support plate has a plurality of wire support tabs and the cover has a holddown flange, whereby the wire support tabs are disposed to provide placement of the power harness therebetween, the holddown flange extending from the cover above the power harness so that the wire support tabs and the holddown flange cooperate to prevent lateral and vertical displacement of the power harness.

13. An improved condensate pump assembly for pumping a condensate liquid, comprising:

a collection tank;

a support plate removably supported by the collection tank;

a pump assembly removably supported by the support plate and having a housing extending into the collection tank, the housing forming, a volute chamber with a fluid outlet conduit and a fluid inlet port, the pump assembly further comprising:

a motor with a drive shaft extending through the housing; and an impeller attached to the drive shaft and disposed in the volute chamber; and a float supported by the support plate determining the level of condensate liquid in the collection tank and communicating with the pump to remove condensate from the collection tank when the condensate reaches a predetermined level.

14. An improved condensate pump assembly for pumping a condensate liquid, comprising:

a collection tank;

a support plate removably supported by the collection tank;

a pump assembly removably supported by the support plate and having a housing extending into the collection tank, the housing forming a volute chamber with a fluid outlet conduit and a fluid inlet port, the pump assembly further comprising:

a motor with a drive shaft extending through the housing; and an impeller attached to the drive shaft and disposed in the volute chamber; and a float supported by the support plate determining the level of condensate liquid in the collection tank and communicating with the pump to remove condensate from the collection tank when the condensate reaches a predetermined level, wherein the float comprises:

a power micro-switch removably supported by the support plate to activate the motor; and a primary float pivotally supported by the support plate and extending into the collection tank, the primary float engaging the power micro-switch when the level of condensate rises to a first predetermined level thereat activating the motor, the primary float falling to a bottom pivot position when the condensate level drops below the predetermined level, thereat disengaging the power micro-switch to deactivate the motor.

15. The condensate pump assembly of claim 14 capable of activating a low voltage control system, and wherein the float further comprises:

a safety micro-switch removably supported by the support plate; and a safety float extending into the collection tank to detect when the condensate level reaches a second predetermined level above the first predetermined level, the safety micro-switch attachable to the low voltage control system.

16. The condensate pump assembly of claim 15 comprising a cover attachable to the support plate and enclosing portions of the pump and the float.

17. The condensate pump assembly of claim 16 wherein the collection tank has a plurality of retention lips disposed at its opening and the support plate has corresponding retention lips that removably interlock with the retention lips of the collection tank so that the support plate and the collection tank snap together thereby securing the support plate to the collection tank.

18. The condensate pump assembly of claim 17 further comprising a power harness connected to the motor, and wherein the support plate has a plurality of wire support tabs and the cover has a holddown flange, whereby the wire support tabs are disposed to provide placement of the power harness therebetween, the holddown flange extending from the cover above the power harness so that the wire support tabs and the holddown flange cooperate to prevent displacement of the power harness.

19. The condensate pump assembly of claim 18 wherein the collection tank has a co-planer mounting flange for mounting to a vertical wall surface, the collection tank having a wedge shaped portion adjacent to the flange to level the collection tank when the collection tank is affixed to the vertical wall.

20. The condensate pump assembly of claim 19 wherein the collection tank and the support plate are made of acetyl butadiene styrene or other semi-rigid plastic.

* * * * *

UNITED STATES PATENT AND TRADEMARK OFFICE

CERTIFICATE OF CORRECTION

PATENT NO. : 6,322,326 B1
DATED : November 27, 2001
INVENTOR(S) : Lee W. Davis et al.

It is certified that error appears in the above-identified patent and that said Letters Patent is hereby corrected as shown below:

Title page,
Insert Item to read -- [73] Assignee: Little Giant Pump Company --.

Signed and Sealed this

Second Day of September, 2003

JAMES E. ROGAN
*Director of the United States Patent and Trademark Office*